US009257229B2

(12) United States Patent
Sarver et al.

(10) Patent No.: US 9,257,229 B2
(45) Date of Patent: Feb. 9, 2016

(54) CAST SPLIT LOW VOLTAGE COIL WITH INTEGRATED COOLING DUCT PLACEMENT AFTER WINDING PROCESS

(75) Inventors: Charlie H. Sarver, Rocky Gap, VA (US); William E. Pauley, Bland, VA (US)

(73) Assignee: ABB Technology AG, Zurich (CH)

( * ) Notice: Subject to any disclaimer, the term of this patent is extended or adjusted under 35 U.S.C. 154(b) by 12 days.

(21) Appl. No.: 14/240,415

(22) PCT Filed: May 9, 2012

(86) PCT No.: PCT/US2012/053734

§ 371 (c)(1), (2), (4) Date: Feb. 24, 2014

(87) PCT Pub. No.: WO2013/039744

PCT Pub. Date: Mar. 21, 2013

(65) Prior Publication Data

US 2014/0210124 A1 Jul. 31, 2014

Related U.S. Application Data

(60) Provisional application No. 61/533,825, filed on Sep. 13, 2011.

(51) Int. Cl.
*H01H 27/10* (2006.01)
*H01F 41/06* (2006.01)
(Continued)

(52) U.S. Cl.
CPC ..... *H01F 41/0608* (2013.01); *H01F 27/00* (2013.01); *H01F 27/02* (2013.01); *H01F 27/085* (2013.01); *H01F 27/2876* (2013.01); *H01F 27/322* (2013.01); *H01F 27/327* (2013.01);
(Continued)

(58) Field of Classification Search
CPC ..... H01F 27/00–27/30
USPC ..... 336/55–62
See application file for complete search history.

(56) References Cited

U.S. PATENT DOCUMENTS 3,431,524 A 4/1969 Broverman
3,548,355 A 12/1970 Martincic et al.
(Continued)

FOREIGN PATENT DOCUMENTS

WO 9216955 A1 10/1992
WO 2008013600 A2 1/2008
WO 2011031960 A1 3/2011

OTHER PUBLICATIONS

International Search Report & Opinion in PCT/US12/53734 dated Nov. 20, 2012.

*Primary Examiner* — Tuyen Nguyen
(74) *Attorney, Agent, or Firm* — Manelli Selter PLLC; Edward J. Stemberger

(57) ABSTRACT

A coil for a transformer includes first and second coil segments with each coil segment being defined by successive layers of wound conductor sheeting. The coil segments are electrically connected together and are adjacent, defining a space there-between. A plurality of cooling duct pairs are disposed between certain of the layers in each of the first and second coil segments such that, for each cooling duct pair, an end of a cooling duct disposed in the first coil segment is adjacent to an end of a cooling duct disposed in the second coil segment, with the ends being disposed in the space. A connector connects the adjacent ends of each pair of cooling ducts.

12 Claims, 4 Drawing Sheets

(51) Int. Cl.

| | |
|---|---|
| ***H01F 27/00*** | (2006.01) |
| ***H01F 27/02*** | (2006.01) |
| ***H01F 27/28*** | (2006.01) |
| ***H01F 27/32*** | (2006.01) |
| ***H01F 41/12*** | (2006.01) |
| ***H01F 27/08*** | (2006.01) |
| ***H01F 41/10*** | (2006.01) |

(52) U.S. Cl.
CPC ..... *H01F 41/10* (2013.01); *H01F 41/127* (2013.01); *Y10T 29/49071* (2015.01)

(56) References Cited

U.S. PATENT DOCUMENTS 4,219,791 A 8/1980 Moore et al.
4,363,012 A * 12/1982 Daikoku ..... H01F 27/322 336/185
4,523,169 A 6/1985 Hay
4,540,536 A 9/1985 Altmann et al.
5,167,063 A 12/1992 Hulsink
5,296,829 A * 3/1994 Kothmann ..... H01F 27/322 336/185
5,588,201 A * 12/1996 Alber ..... H01F 41/127 29/602.1
6,221,297 B1 4/2001 Lanoue et al.
6,223,421 B1 5/2001 Lanoue et al.
6,368,530 B1 * 4/2002 Adubato ..... F28D 7/024 264/154
6,806,803 B2 10/2004 Hopkinson et al.
6,930,579 B2 8/2005 Radford et al.
7,023,312 B1 4/2006 Lanoue et al.
7,647,692 B2 1/2010 Lanoue et al.
7,688,170 B2 3/2010 Pauley, Jr. et al.
7,719,397 B2 5/2010 Pauley, Jr. et al.
8,183,972 B2 * 5/2012 Hjortsberg ..... H01F 27/322 336/175
2010/0271166 A1 10/2010 Farmer et al.
2011/0063062 A1 3/2011 Lim et al.

* cited by examiner

CAST SPLIT LOW VOLTAGE COIL WITH INTEGRATED COOLING DUCT PLACEMENT AFTER WINDING PROCESS

This application claims priority from U.S. Provisional Application No. 61/533,825, filed on Sep. 13, 2011.

FIELD

The invention relates to transformers and more particularly, to transformers having a cast, split low voltage coil with cooling ducts.

BACKGROUND

It is well known that a transformer converts electricity at one voltage to electricity as another voltage, either of higher or lower value. A transformer achieves this voltage conversion using a primary coil and a secondary coil, each of which is wound on a ferromagnetic core and comprises a number of turns of an electrical conductor. The primary coil is connected to a source of voltage and the secondary coil is connected to a load. The ratio of turns in the primary coil to the turns in the secondary coil ("turns ratio") is the same as the ratio of the voltage of the source to the voltage of the load. Two main winding techniques are used to form coils, namely layer winding and disc winding. The type of winding technique that is utilized to form a coil is primarily determined by the number of turns in the coil and the current in the coil. For high voltage windings with a large number of required turns, the disc winding technique is typically used, whereas for low voltage windings with a smaller number of required turns, the layer winding technique is typically used.

A layer winding technique is disclosed in U.S. Pat. No. 6,221,297 to Lanoue et al., which is assigned to the assignee of the present application, ABB Inc., and which is hereby incorporated by reference. In the Lanoue et al. '297 patent, alternating sheet conductor layers and sheet insulating layers are continuously wound around a base of a winding mandrel to form a coil. The winding technique of the Lanoue et al. '297 patent can be performed using an automated dispensing machine, which facilitates the production of a layer-wound coil.

A transformer with layer windings may be dry, i.e., cooled by air as opposed to a liquid dielectric. In such a dry transformer, the windings may be coated with, or cast in, a dielectric resin using vacuum chambers, gelling ovens etc. If the windings are cast in a solid dielectric resin, cooling issues are raised. Cooling ducts have been provided in layer wound coils.

The larger the transformer and higher output rating, the greater the width of the conductor sheet is required or larger amount of conductor used. One cannot wind a conductor sheet above 48 inches on existing equipment.

Thus, there is a need to provide a coil for a transformer, with the coil having split coil segments with cooling ducts.

SUMMARY

An object of the invention is to fulfill the need referred to above. In accordance with the principles of an embodiment, this objective is achieved by a method of providing cooling ducts in a coil of a transformer. The coil includes a first coil segment and a second coil segment. The method includes the step of a) providing a first mold for the first coil segment, b) winding conductor sheeting around the mold to form a plurality of conductor layers, c) during the winding, placing spacers between certain of the conductor layers, d) placing segmented cooling ducts in channels created by the spacers, e) providing a second mold for the second coil segment, f) performing steps b) though e) to provide the second coil segment with spacers and cooling ducts, g) electrically connecting the first and second coil segments together so as to define a space between the coil segments, h) inserting cooling ducts into a cavities defined by the spacers in each of the first and second coil segments so as to define pairs of adjacent cooling ducts, i) for each pair of cooling ducts, connecting an end of a cooling duct disposed in the first coil segment with an adjacent end of a cooling duct disposed in the second coil segment, and j) removing the spacers.

In accordance with yet another aspect of an embodiment, a coil for a transformer includes first and second coil segments with each coil segment being defined by successive layers of wound conductor sheeting. The coil segments are electrically connected together and are adjacent, defining a space therebetween. A plurality of cooling duct pairs are disposed between certain of the layers in each of the first and second coil segments such that, for each cooling duct pair, an end of a cooling duct disposed in the first coil segment is adjacent to an end of a cooling duct disposed in the second coil segment, with the ends being disposed in the space. A connector connects the adjacent ends of each pair of cooling ducts.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings wherein like numbers indicate like parts, in which.

DETAILED DESCRIPTION OF THE EXEMPLARY EMBODIMENTS

Figure 1:
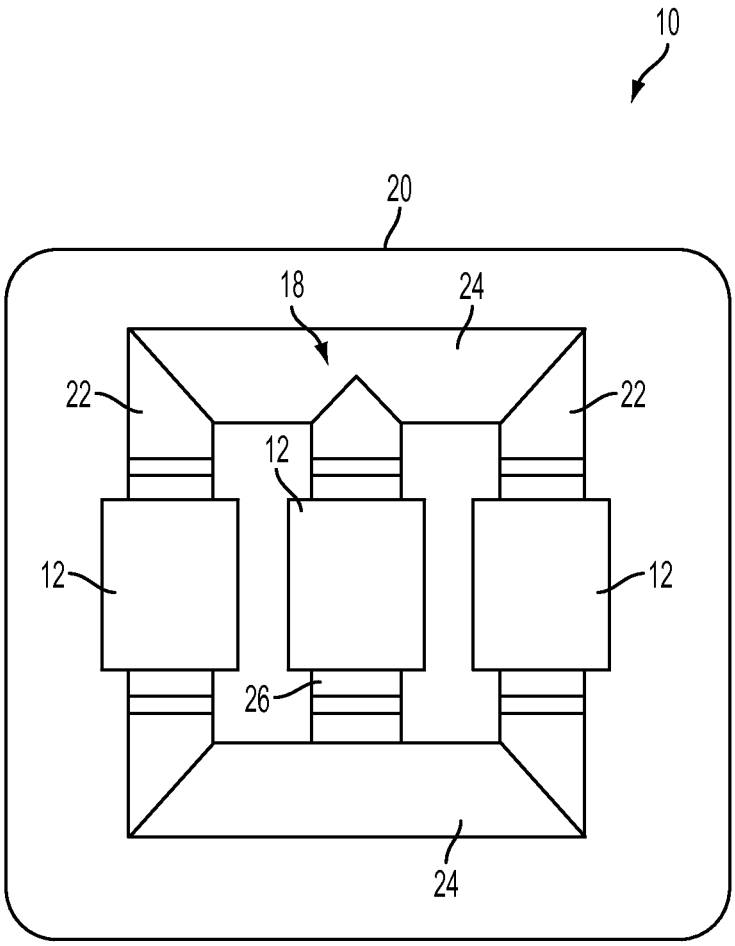
FIG. 1 is a schematic view of a transformer having a coil in accordance with an embodiment of the invention.

Referring now to FIG. 1, there is shown a schematic view of a three phase transformer, generally indicated at 10, containing a coil embodied in accordance with the present invention. The transformer 10 comprises three coil assemblies 12 (one for each phase) mounted to a core, generally indicated at 18, and enclosed within an outer housing 20. The core 18 is comprised of ferromagnetic metal and is generally rectangular in shape. The core 18 includes a pair of outer legs 22 extending between a pair of yokes 24. An inner leg 26 also extends between the yokes 24 and is disposed between and is substantially evenly spaced from the outer legs 22. The coil assemblies 12 are mounted to and disposed around the outer legs 22 and the inner leg 26, respectively. Each coil assembly 12 comprises a high voltage coil and a low voltage coil 28 (shown in FIG. 3), each of which is of elliptical or cylindrical in shape. If the transformer 10 is a step-down transformer, the high voltage coil is the primary coil and the low voltage coil 28 is the secondary coil. Alternately, if the transformer 10 is a step-up transformer, the high voltage coil is the secondary coil and the low voltage coil 28 is the primary coil. In each coil assembly 12, the high voltage coil and the low voltage coil 28 may be mounted concentrically, with the low voltage coil 28 being disposed within and radially inward from the high voltage coil, as shown in FIG. 1. Alternately, the high voltage coil and the low voltage coil 28 may be mounted so as to be axially separated, with the low voltage coil 28 being mounted above or below the high voltage coil. In accordance with the present invention, each low voltage coil 28 comprises concentric layers of conductor sheeting 38 to which coil bus bars are secured.

The transformer 10 is a distribution transformer and the voltage of the high voltage coil is in a range of from about 13,200-13,800 V and the voltage of the low voltage coil 28 is in a range from about 480 to about 277 V.

Although the transformer 10 is shown and described as being a three phase distribution transformer, it should be appreciated that the present invention is not limited to three phase transformers or distribution transformers. The present invention may be utilized in single phase transformers and transformers other than distribution transformers.

Figure 2:
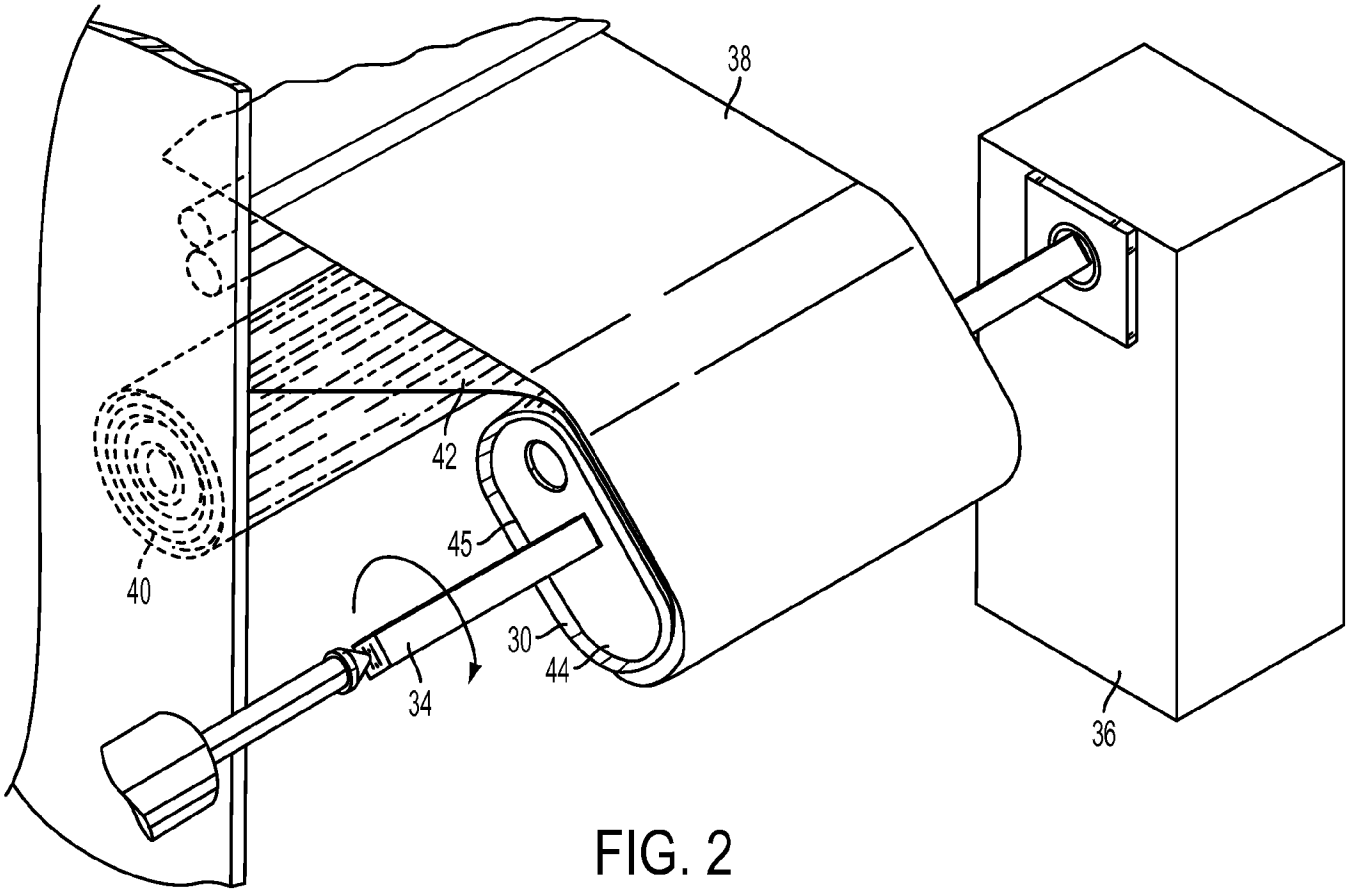
FIG. 2 is a perspective view showing a coil segment being wound on a winding machine in accordance with an embodiment.
Figure 3:
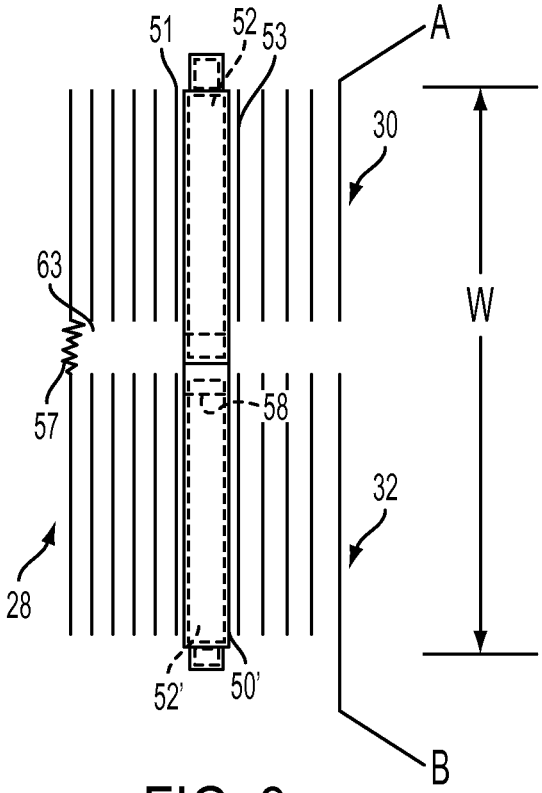
FIG. 3 is a schematic view of a split, low voltage coil with a spacer and cooling ducts shown therein, in accordance with an embodiment.

With reference to FIG. 3, the coil 28 is of the split or segmented type having a first coil segment 30 and a second coil segment 32. Referring now to FIG. 2, a segment 30 of one of the low voltage coils 28 is shown being formed on a winding mandrel 34 of a winding machine 36. A roll (not shown) of the conductor sheeting 38 and a roll 40 of insulator sheeting 42 are disposed adjacent to the winding machine 36. An inner support or mold 44 composed of sheet metal or other suitable material is mounted on the mandrel 34. The inner mold 44 may be first wrapped with an insulation material 45 comprised of woven glass fiber. An inner end of the conductor sheeting 38 is disposed over and is aligned with an inner end of the insulator sheeting 42 and is secured to the inner mold 44. The mandrel 34 is then rotated, thereby causing the conductor sheeting 38 and the insulator sheeting 42 to be dispensed simultaneously from the rolls thereof, and to be wound around the insulating material on the mold 44 to form a first conductor layer 46 (FIG. 4).

Figure 4:
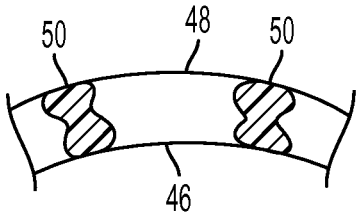
FIG. 4 is a top showing spacers between two winding layers of a coil segment.
Figure 7:
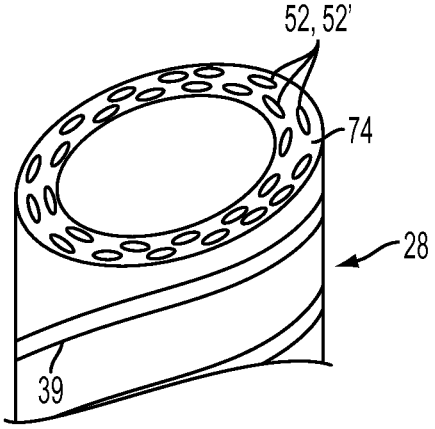
FIG. 7 is a partial perspective view of an encapsulated, split low voltage coil having cooling ducts in accordance with an embodiment.

FIG. 4 is a top view of a first conductor layer 46 and a second conductor layer 48 (of conductor sheeting 38 and insulator sheeting 42). After the first conductor layer 46 is wound, segmented, insulating spacers 50 are placed between the first conductor layer 46 and second conductor layer 48 when the conductor sheeting 38 and insulator sheeting 42 are wound simultaneously. Alternatively, the spacers 50 can be placed between the first and second layers of conductor sheeting 38 as the second layer of conductor sheeting 38 is being wound. The spacers 50 are preferably in the form of elongated sticks and are comprised of insulating material such as polyester, polyimide, polyamide and may be composed of a fiber reinforced plastic in which fibers, such as fiberglass fibers are impregnated with a thermoset resin, such as polyester resin, a vinyl ester resin or an epoxy resin. Alternate layers of conductor sheeting 38 and insulator sheeting 42 are wound to form successive layers of the coil segment 30. The spacers 50 can be provided between each layer or between alternating layers depending on the particular coil construction. To complete the coil segment 30, a final insulating sheeting 38 is wound or the coil segment 30 is secured with an insulting member such as a glass net or tape 39 (FIG. 7). The second coil segment 32 is formed over a second mold on the winding machine 36, in the same manner as coil segment 30 is formed to include the spacers 50'.

Figure 5:
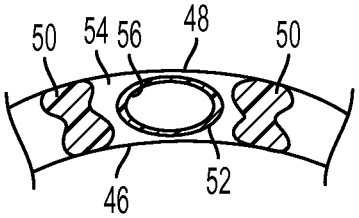
FIG. 5 is a view of FIG. 4, but shown with a cooling duct inserted between the spacers.

Next, with reference to FIG. 5 and describing first coil segment 30, after completion of the winding process, segmented cooling ducts 52 are placed into the channels 54 created by the spacers 50, between a pair or spacers 50. The cooling ducts 52 can be of the same material as the spacers. Each cooling duct 52 is in the form of a hollow tube, having a passage 56 there-through. Cooling ducts 52' are provided in the second coil segment 32 in a similar manner.

The coil segments 30, 32 arranged adjacently and are attached together electrically by electrical connection 57 (FIG. 3) so as to define a space 63 there-between. As shown in FIG. 3, when the coil segments 30 and 32 are adjacent, each spacer 50 in coil segment 30 generally abuts a corresponding spacer 50' in coil segment 32. Instead of providing the plurality of abutted pairs of spacers, a plurality of single spacers can be provided that extend through both of the coil segments 30 and 32. Although only a single pair of spacers 50, 50' is shown in FIG. 3 between layers 51 and 53, it can be appreciated that a plurality of pairs of spacers 50, 50' are provided between certain layers of the coil segments 30, 32.

Figure 6:
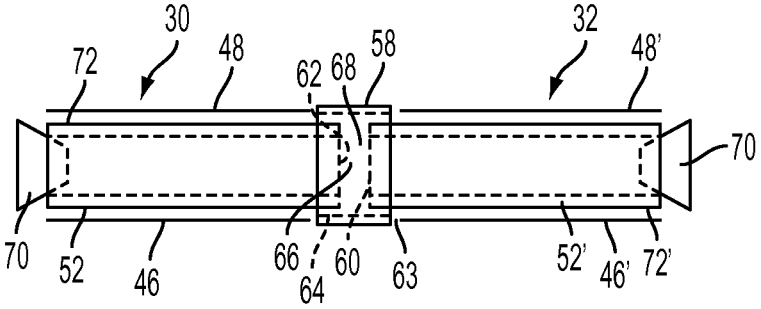
FIG. 6 shows first and second coil segments joined by coupling ends of cooling ducts.

The next step of assembly is shown in FIG. 6, where a mechanical connection between the coil segments 30 and 32 is performed. For the mechanical connection, a connector 58 couples ends 60 and 62 of a pair of adjacent cooling ducts 52, 52'. In particular, the connector 58 couples end 60 of cooling duct 52', disposed in the coil segment 32, with end 62 of the cooling duct 52, disposed in coil segment 30. The ends 60 and 62 extend into the space 63 between the adjacent coil segments 30 and 32. The connector 58 is a short, hollow duct having a passage 64 there-through. The adjacent ends 60 and 62 of a pair of cooling ducts 52, 52' are slid into the passage 64 and then secured therein by epoxy 66, superglue, or other adhesive. As shown in FIG. 6, a small gap 68 is provided between the ends 60 and 62. FIG. 3 shows spacers 50, 50' in front of cooling ducts 52, 52', which are coupled by connector 58. Since a plurality of cooling ducts is provided, a connector 58 is provided for each pair of adjacent cooling ducts.

Next, the spacers 50 are removed and plugs 70 (FIG. 6) are placed in the open ends 72, 72' of the cooling ducts 52, 52' respectively. The plugs 70 are configured to vent and can be gripped for removal as described in U.S. Pat. No. 7,647,692, the content of which is hereby incorporated by reference into this specification. The coil segments 30, 32 are then encapsulated in epoxy resin in the conventional manner (as disclosed in U.S. Pat. No. 7,647,692). The plugs 70 are then removed from the cooling ducts 52, 52' by punching them out with a long rod or by gripping and pulling the plugs 70 out, with the cooling ducts 52, 52' being permanently integrated into the coil 28. FIG. 7 shows a top perspective view of the completed coil 28 with cooling ducts 52, 52' and epoxy encapsulation 74. The coil 28 can then be mounted to the core 18 of the transformer of FIG. 1.

Thus, the embodiment provides a low voltage, spit coil 28 having cooling ducts or ducts therein. The coil 28 reduces use and cost of insulation and reduces voltage stresses to the core

18. Although a layer winding process is disclosed, the segmented cooling ducts 52, 52' can be used in a disc winding process.

As noted above, a reason for fabricating a segmented low voltage coil 28 with segmented cooling ducts is because the larger the transformer and higher output rating, the greater the width of the conductor sheet required (or larger amount of conductor used in general). One cannot wind a conductor sheet above 48 inches on existing equipment, thus the split coil system is used to define the coil 28 having a width W (FIG. 3) greater than 48 inches.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A coil for a transformer comprising:

first and second coil segments, each coil segment being defined by successive layers of wound conductor sheeting, the coil segments being electrically connected together and being adjacent, defining a space there-between, a plurality of hollow cooling duct pairs disposed between certain of the layers in each of the first and second coil segments such that, for each cooling duct pair, an end of a cooling duct disposed in the first coil segment is adjacent to an end of a cooling duct disposed in the second coil segment, with the ends being disposed in the space, and a hollow connector connecting the adjacent ends of each pair of cooling ducts so as to define a continuous hollow cooling duct extending axially from an end of the first coil segment to an end of the second coil segment.

2. The coil of claim 1, further comprising an adhesive sealant coupling the adjacent ends to the connector.

3. The coil of claim 1, further comprising an insulator sheeting disposed adjacent to each layer of conductor sheeting.

4. The coil of claim 1, further comprising a resin encapsulating the layers and cooling ducts.

5. The coil of claim 1, wherein each cooling duct comprises a fiber reinforced plastic in which fibers are impregnated with a thermoset resin.

6. The coil of claim 5, wherein each cooling duct comprises polyester resin reinforced with fiberglass fibers.

7. The coil of claim 1, wherein the coil has a width greater than 48 inches.

8. The coil of claim 1, wherein a space is provided between the adjacent ends of each pair of cooling ducts.

9. The coil of claim 2, wherein the connector is a hollow tube.

10. The coil of claim 1, in combination with a core of a transformer.

11. The combination of claim 10, wherein the coil is a low voltage coil of the transformer having a voltage range from about 480 to about 277 V.

12. The coil of claim 1, wherein each of the cooling duct pairs, and the connector, is an individual hollow tube having a passage there-through.

* * * * *